US007837606B2

(12) United States Patent
Tetenborg et al.

(10) Patent No.: US 7,837,606 B2
(45) Date of Patent: Nov. 23, 2010

(54) METHOD FOR THE PRODUCTION OF BAGS

(75) Inventors: Konrad Tetenborg, Lengerich (DE); Uwe Koehn, Osnabrueck (DE); Siegfried Maneke, Lengerich (DE); Jan Thorsten Weber, Lengerich (DE)

(73) Assignee: Windoeller & Hoelscher, Lengerich (DE)

( * ) Notice: Subject to any disclaimer, the term of this patent is extended or adjusted under 35 U.S.C. 154(b) by 0 days.

(21) Appl. No.: 10/544,101

(22) PCT Filed: Feb. 13, 2004

(86) PCT No.: PCT/EP2004/002083

§ 371 (c)(1),
(2), (4) Date: Aug. 2, 2005

(87) PCT Pub. No.: WO2004/071752

PCT Pub. Date: Aug. 26, 2004

(65) Prior Publication Data

US 2006/0088676 A1 Apr. 27, 2006

(30) Foreign Application Priority Data

Feb. 14, 2003 (DE) ..... 103 06 615

(51) Int. Cl.
*B31B 1/26* (2006.01)

(52) U.S. Cl. ..... 493/231; 493/194; 493/223; 493/224; 493/239

(58) Field of Classification Search ..... 493/194, 493/195, 198, 223, 224, 231, 239, 343, 345, 493/346, 380, 381; 53/570, 451, 469
See application file for complete search history.

(56) References Cited

U.S. PATENT DOCUMENTS

| | | | | | |
|---|---|---|---|---|---|
| 4,708,705 | A | * | 11/1987 | Aubry et al. | 493/211 |
| 4,873,815 | A | * | 10/1989 | Tetenborg et al. | 53/570 |
| 4,889,523 | A | * | 12/1989 | Sengewald | 493/195 |
| 4,892,511 | A | * | 1/1990 | Luciano et al. | 493/194 |
| 4,988,332 | A | * | 1/1991 | Mattle | 493/196 |
| 5,102,384 | A | * | 4/1992 | Ross et al. | 493/243 |
| 5,139,346 | A | * | 8/1992 | Watanabe et al. | 383/107 |
| 5,474,818 | A | * | 12/1995 | Ulrich et al. | 428/34.3 |
| 6,080,093 | A | * | 6/2000 | Henderson et al. | 493/187 |
| 6,126,315 | A | | 10/2000 | Ichikawa et al. | |
| 6,132,351 | A | * | 10/2000 | Lotto et al. | 493/210 |
| 6,195,964 | B1 | * | 3/2001 | Kitao | 53/449 |
| 6,254,521 | B1 | * | 7/2001 | Pansier et al. | 493/341 |
| 6,401,439 | B1 | | 6/2002 | Tetenborg et al. | |

(Continued)

FOREIGN PATENT DOCUMENTS

DE 44 23 964 C1 12/1995

(Continued)

*Primary Examiner*—Hemant M Desai
(74) *Attorney, Agent, or Firm*—Jacobson Holman PLLC

(57) ABSTRACT

A process for manufacturing a bag from a polymer and/or metal film material provides a bag that has four outer walls connected by four seams and that has a sealed lower end.

The bag-forming material is fed in the form of a film web that is wound up on a roll to an unwinding station of a bottom forming device that separates the unwound film web into film segments, connects the film segments, and seals at least one end of the connected segments to form the bag.

8 Claims, 6 Drawing Sheets

U.S. PATENT DOCUMENTS

| | | | | |
|---|---|---|---|---|
| 6,460,317 | B1 | 10/2002 | Voss | |
| 6,474,050 | B1 | 11/2002 | Tetenborg | |
| 6,561,963 | B2 * | 5/2003 | Totani | 493/218 |
| 6,740,020 | B2 * | 5/2004 | Horibe et al. | 493/218 |
| 6,796,932 | B2 * | 9/2004 | Kuge et al. | 493/218 |
| 6,800,051 | B2 * | 10/2004 | Koehn | 493/227 |
| 6,902,639 | B1 * | 6/2005 | Perelman et al. | 156/203 |
| 2002/0168120 | A1 | 11/2002 | Wessling et al. | |
| 2004/0109618 | A1 * | 6/2004 | Marbler et al. | 383/207 |
| 2007/0148382 | A1 * | 6/2007 | Koehn et al. | 428/35.2 |

FOREIGN PATENT DOCUMENTS

| | | | |
|---|---|---|---|
| DE | 199 20 478 | A1 | 11/2000 |
| DE | 199 33 486 | A1 | 11/2000 |
| DE | 199 36 660 | A1 | 11/2000 |
| DE | 199 33 446 | C1 | 3/2001 |
| EP | 0 534 062 | A1 | 3/1993 |
| EP | 1 069 430 | A1 | 1/2001 |
| GB | 1057264 | | 2/1967 |
| WO | WO 02/057150 | A1 | 7/2002 |

* cited by examiner

METHOD FOR THE PRODUCTION OF BAGS

This is a nationalization of PCT/EP2004/002083 filed 13 Feb. 2004 and published in German.

BACKGROUND OF THE INVENTION

1. Field of Invention

The present invention relates to a process for manufacturing bags. Furthermore, the process aims to provide protection for the film tube rolls used in the process.

2. Description of the Prior Art

Bags are manufactured using, among others, the so-called Form, Fill and Seal Machines, referred to in the following description as FFS machines.

Such machines are disclosed in the published patents DE 199 33 486, EP 534 062, DE 44 23 964, DE 199 20478 and DE 199 36 660. The FFS machines have unwinding stations on which film tubes are stored. These unwinding stations unwind the film tubes and separate them into film tube segments. Usually in the later process steps, the film tubes are provided with bottoms, the resulting bag is filled with the filling material and the bag is sealed. The type of bag forming and filling suggested in the aforementioned published patents is also a part of the contents of this disclosure. The same applies to the provisions of the term 'Form, Fill and Seal machines' (FFS) and also the processes of transporting the film tubes, film segments and bags into these machines. As a rule, these machines are used to fill the bags with bulk materials.

Usually, film tubes are formed by blown film extrusion for the purpose of processing using FFS machines. The format of these film tubes (here, their periphery) is in agreement with the bag formed. This approach necessitates the relatively expensive replacement of formats in the blown film extrusion plants for the purpose of realizing different bag formats. Moreover, the formats required for the bag formation are relatively small and hence cannot be manufactured economically. Blown film extrusion plants of bigger format produce the same foil at much lesser costs per unit of area.

Therefore, experiments have been conducted many times with the purpose of first manufacturing very broad film webs by flat film extrusion or by blown film extrusion using machines of a bigger format. Here also, blown film extrusion plants were preferred primarily for cost reasons. The resulting film tubes or film webs of a big format were then processed further to flat film webs by cutting them as per the format required.

Subsequently, one of these flat film webs is folded up and joined by a longitudinal joint seam to form a film tube. A disadvantage of such usually very short film tubes is that the thick joint created by the longitudinal joint seam complicates the winding process of the film tube, since the rolled-up film tube tends to telescope, i.e. it assumes a frusticonical shape, due to the addition of the thick joints.

Even film tube segments are produced in a similar manner for the purpose of manufacturing bags of a higher quality. Thus, for instance, the manufacture of side-gusset pouches or side-gusset bags are known to prior art that are formed out of several film segments. For this purpose the edges of each of the film segments are usually sealed together. This process is carried out between sealing jaws that clamp the material to be sealed during the sealing process.

This method is used generally to manufacture film tube segments whose length corresponds to that of bags formed later. In other cases, immediately after production, the formed film tube segments are cut immediately to the length of the bags formed later and are fed individually to the bag forming, filling and sealing machines. This type of high quality of bag manufacturing is probably well-known in the pet food sector.

However, both the transportation of individual film tube segments as well as their insertion into a bag forming, filling and sealing machine is an expensive and complex process. This process is usually executed using rotary feeders or other suction devices that grasp the film tube segments individually and feed them to the bag forming machine. Such devices are expensive and prone to breakdown.

SUMMARY OF THE INVENTION

Therefore, the objective of the present invention is to provide a process for manufacturing bags from a polymer and/or metal film material in which the feeding process of a film tube material takes place in an easier manner.

This objective is achieved by feeding the material required for forming the bags, in the form of a film tube (25, 40), that is wound up into a roll, to the unwinding station of a bottom forming device that separates the unwound film tube into film tube segments and seals at least one end of the bag.

It was not possible so far to manufacture film tubes having a length that is desired by the present invention. However, the present description discloses such a manufacturing process. In addition to facilitating the insertion process of the film tubes into the bag forming, filling and sealing machines, the application of the process pursuant to the present invention also involves a reduction in the transportation costs since the rolled up film can be transported conveniently.

The process pursuant to the present invention can be carried out using the aforementioned FFS machines. The additional advantage of using these machines is that they have clearly higher filling speeds than the machines used so far for manufacturing and filling the bags specified in the preamble of the claim 1. The present patent application does not include an illustration of the machine used to execute the process pursuant to this invention. The aforementioned published patents DE 199 33 446, DE 199 20478 and DE 199 36 660 illustrate a class of suitable machines that, in addition to sealing one end of a bag, are also used to fill the bag and seal the other end of the bag. The film tube required for forming the bag is unwound from a roll. The scope of this disclosure aims at achieving these characteristics and forms the content of the present patent application.

The shape of the film roll even prior to its formation, is also accorded a great deal of attention in the following description.

Further scope of applicability of the present invention will become apparent from the detailed description and claims given hereinafter.

DETAILED DESCRIPTION OF THE PREFERRED EMBODIMENTS

Figure 1:
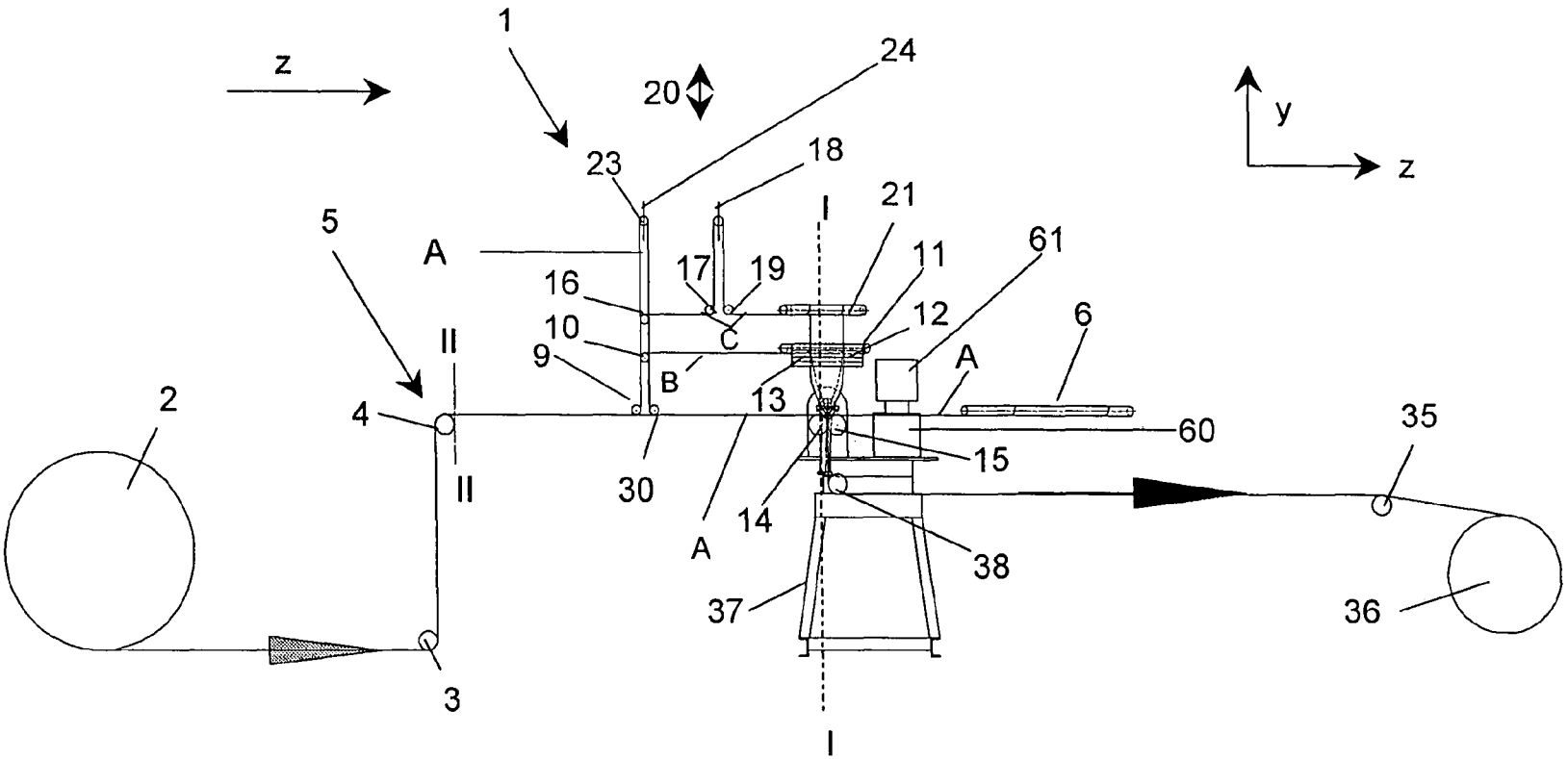
FIG. 1 A side view of a machine pursuant to the invention

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The figures illustrate a machine 1 whose functioning is described below particularly in terms of the path of the film web E through the machine 1. The machine comprises an unwinding station 2 that unwinds the film web E. The film web E is transported, as indicated by the arrow in the direction z of the axis of the film tube that is formed subsequently, and is fed by means of the deflecting rollers 3 and 4 to the cutting station 5 that is symbolized here only by the line II-II. The cutting station comprises cutting tools (not illustrated) that are used to cut the web E into the webs A, B, C and D.

The film web A is turned twice on the turning bars 6 and 7 so that it reverses its direction and is finally fed along the direction z to the joining station 8. In this context it must be mentioned that the turning bar 6 is displaceable in the z-direction so that the longitudinal register of the film web A can be adjusted here. This instance is marked by the arrow 45.

Figure 4:
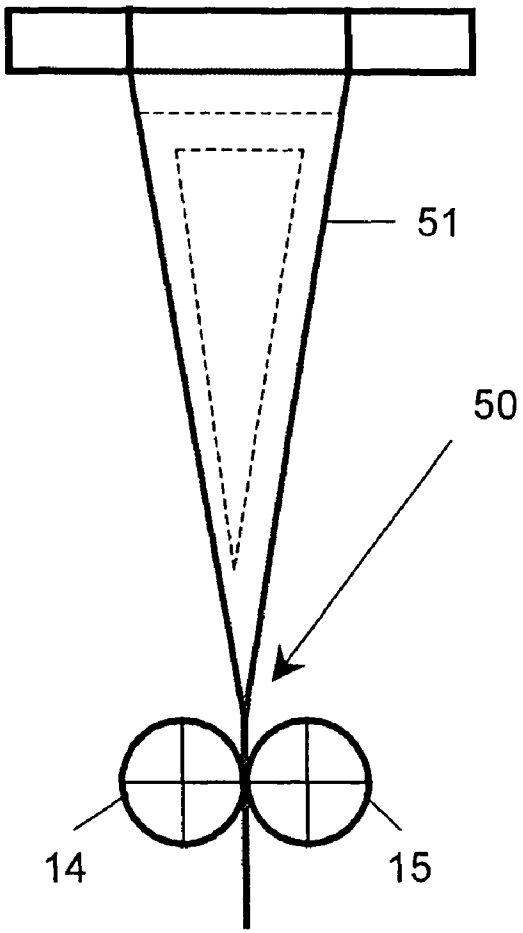
FIG. 4 A sketch of the course of path before the roller clearance 50

The film web B is guided by means of the rollers 9 and 10, the turning bar 11 and the roller 12. At this juncture, it moves temporarily in the x-direction. The film web moves above the joining station 8 by means of the roller 13 that guides it in the direction of the roller clearance 50 between the squeegee rollers 14 and 15. The film web moves between the roller 13 and the roller clearance 50 across a triangle 51 made of section tubes illustrated in FIG. 4. The film web B that was flat previously is folded in this manner so that soon after being squeezed by the squeegee rollers 14 and 15 a clearly defined folded edge is formed in the roller clearance 50 that forms a side gusset 26 in the finished film tube 25. Additional components of the machine pursuant to the invention are not illustrated in FIG. 4.

The longitudinal register of the film web B can also be corrected by displacing the roller 12 in the x-direction (arrow 46).

The film web C is first guided by means of the rollers 9, 16, 17 and 19 where the arrow 20 marks the adjustability of the roller 18 in the y-direction, which again enables a correction of the longitudinal register of the film web C. After passing the roller 19, the film web C moves using the turning bar 21, then moves in x-direction toward the roller 22 which turns the film web C downward in the direction of the roller clearance 50 defined by the squeegee rollers 14 and 15. A side gusset is formed by the folded edge in film web C similar to the aforementioned processing of film web B: After being deflected by the roller 22, the film web C moves across a triangle (not illustrated) made of section tubes whose vertex points toward the roller clearance 50. The film web C thus arrives in the roller clearance 50 in a folded manner. It must be noted here that there are also other alternatives of forming folded edges on film webs and forming side gussets on film tubes or bags that can also be used in the machine pursuant to the invention.

The flat film web D moves through the cutting station 5, then using the rollers 9, 23, 30 into the roller clearance 50 defined by the squeegee rollers 14 and 15. The adjustability of the roller 23 in the y-direction marked by the arrow 24 enables a correction in the longitudinal register of the film web D.

Thus in the illustrated embodiment of the machine 1, all the film webs A-D required for forming the film tube are joined together in the joining station 8 or more precisely in the roller clearance 50 defined by the squeegee rollers 14 and 15.

Two extrusion devices 31 provide extrudate in order to join the joint seams 27 firmly to one another. Strictly speaking, the extrudate is supplied in the extruder 32 in which an extruder screw generates high pressure. The extrudate is transported by means of the extruder arms 33*a, b* and using the roller clearance 50 to the joining station 8. Here the extrudate is extruded by the nozzles 34*a, b*, 35*a, b* provided for this purpose onto the edges of the film webs A-D that are joined to one another in the roller clearance 50 immediately after this process.

Usually the extrudate is applied in a heated state so that its coagulation joins the film webs more tightly. Polyolefins can be used as extrudates. However, it is also possible to use all forms of adhesives or to weld the edges of the film webs.

The film tube 25 is formed soon after leaving the roller clearance 50. First it is conveyed in the direction of the gravitational force. This alignment of the film tube is advantageous for solidifying the joint seams 27 and/or for distributing the extrudate.

Figure 2:
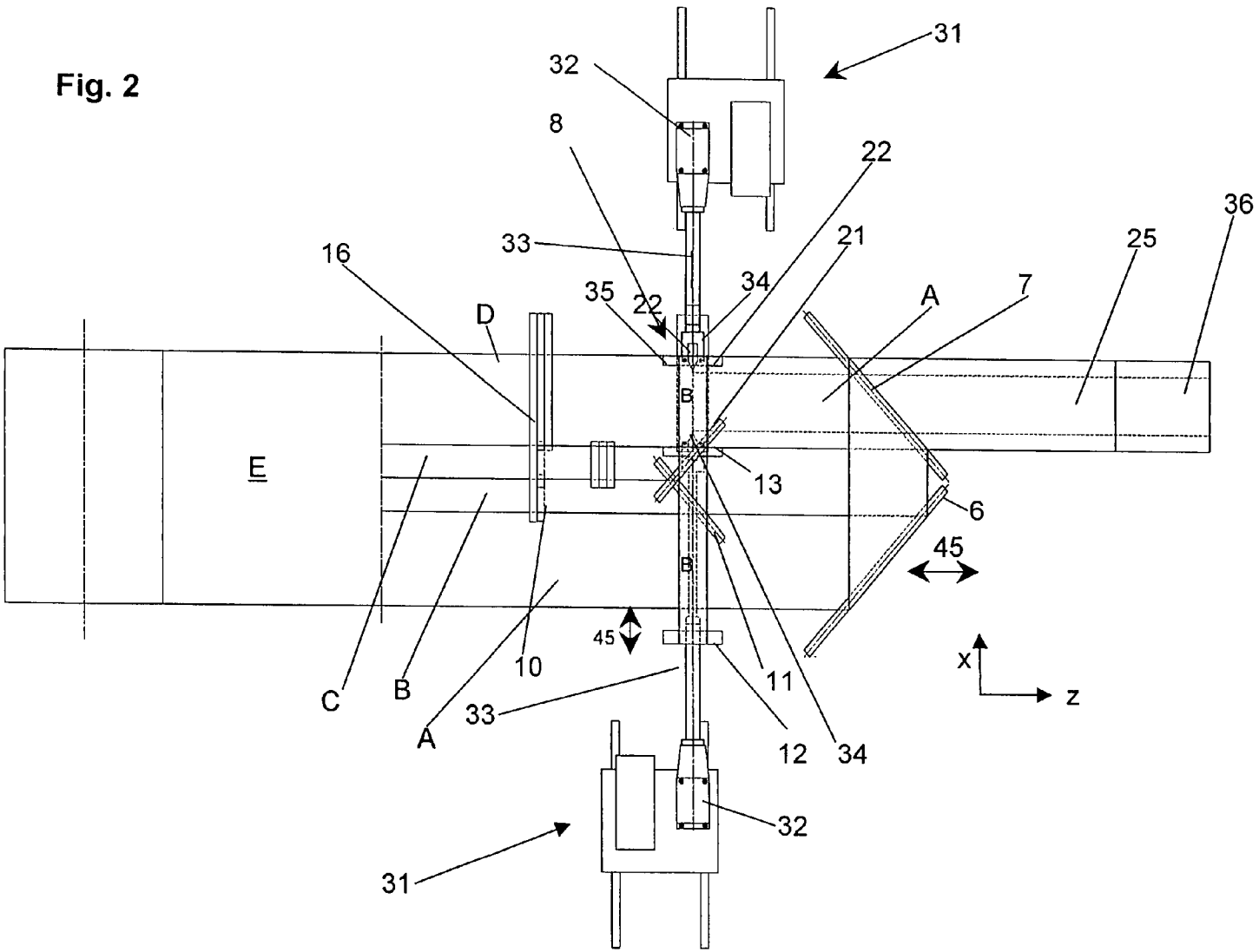
FIG. 2 A top view of the machine pursuant to the invention illustrated in FIG. 1
Figure 3:
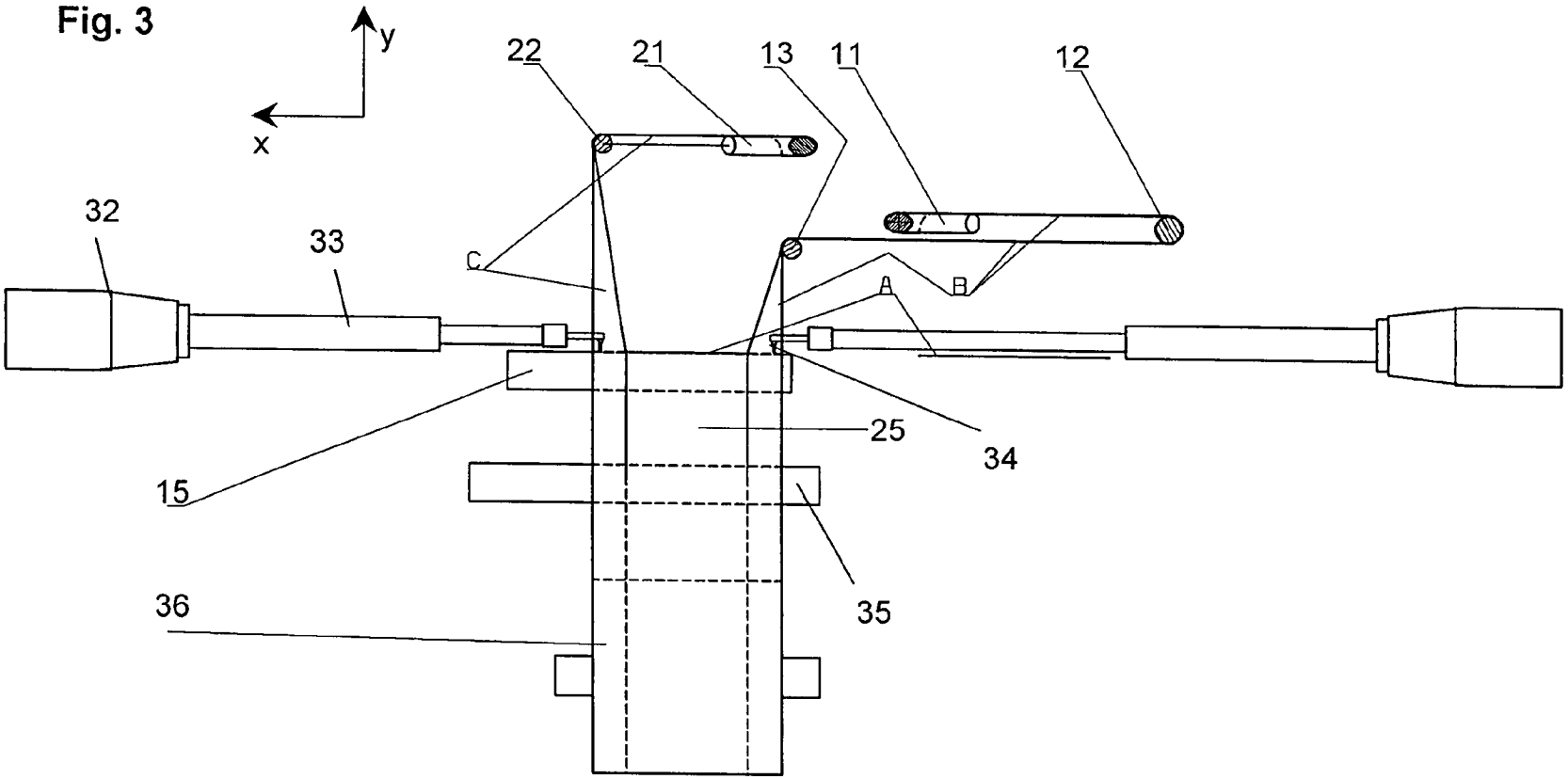
FIG. 3 The cross-section I-I of the machine illustrated in FIG. 1

Finally the film tube 25 moves by means of the rollers 38 and 35 to the winding station 36 that is illustrated symbolically in the figures. FIGS. 1 to 3 also illustrate the motor 60 that transfers a torsional moment on the extruder by means of a belt that is not illustrated, a fan 61 and the machine frame 37. Additional adhesive elements of other machine components such as rollers or guide rods are not illustrated since the bearing and mounting of such components are obvious to those skilled in this art. Similarly, other machine components that are well-known in principle, such as the winding and unwinding stations are illustrated symbolically.

Figure 5:
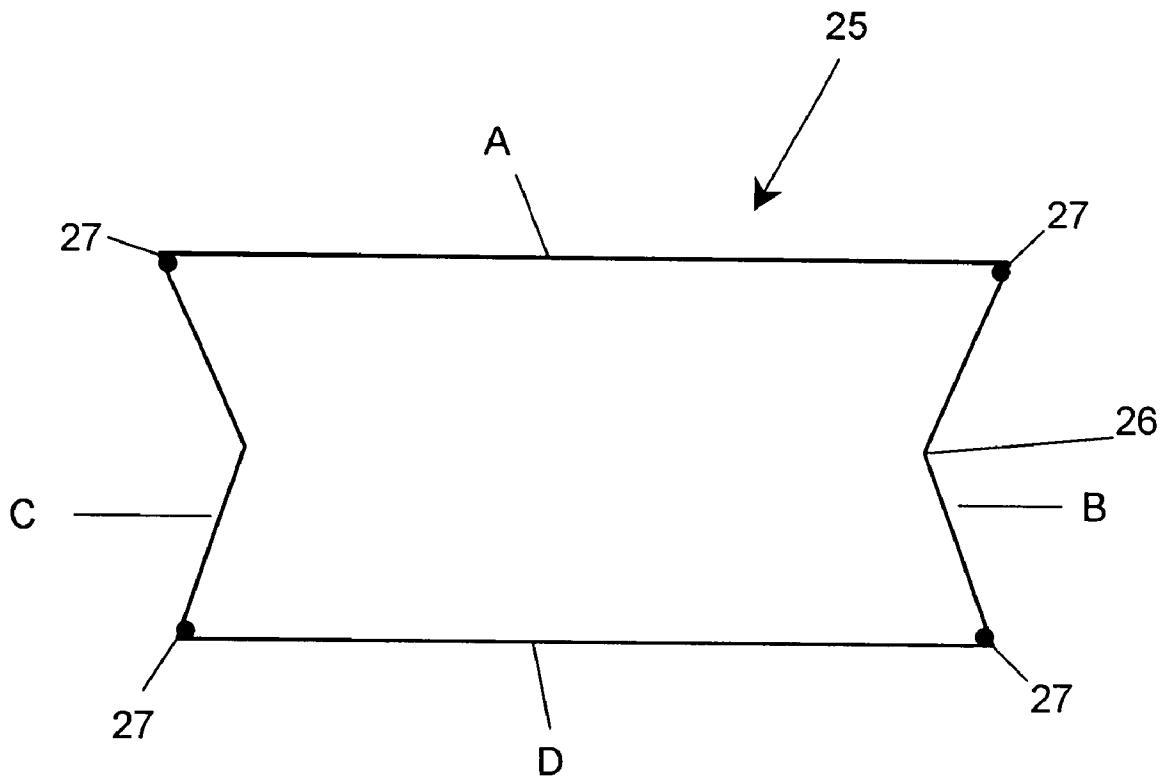
FIG. 5 A cross-section of a film tube pursuant to the invention

FIG. 5 illustrates the cross-section of a film tube 25 for a bag manufactured by the machine pursuant to the invention. FIG. 5 illustrates the film webs A-D, the joint seams 27 joining them and also the side gussets 26.

Figure 6:
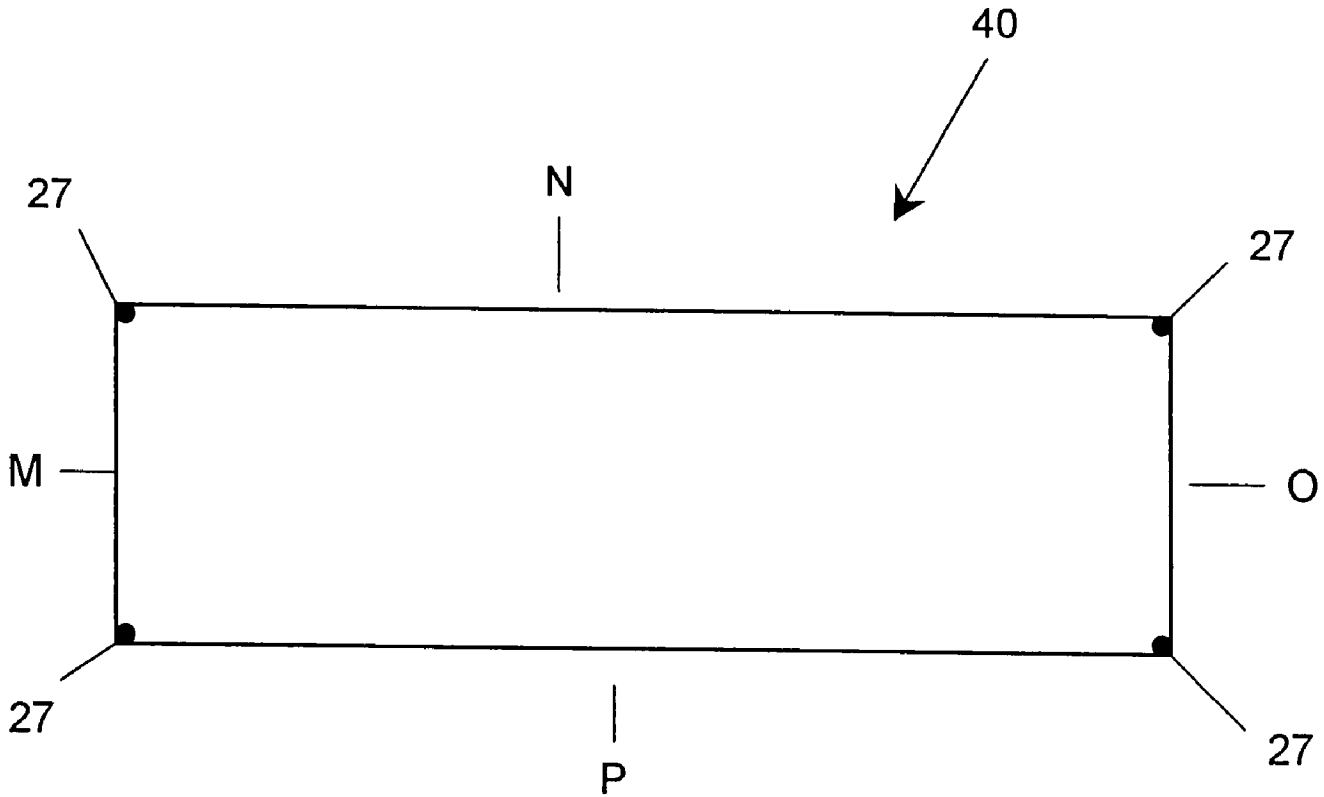
FIG. 6 A cross-section of an additional film tube pursuant to the invention

FIG. 6 illustrates another cross-section of a bag pursuant to the present invention. The film tube 40 illustrated in FIG. 6, like the film tube 25 illustrated in FIG. 5, comprises four joined seams 27 that join the four film webs M, N, O, and P to one another. As opposed to the film tube 25, film tube 40 has no side gussets 26.

In conclusion, it must be stated emphatically that the illustrated film tubes pursuant to the present invention can also be processed further to manufacture end products other than FFS-bags. Particularly, the side-gusseted film tube 25 can be used in various applications.

Finally, it must also be mentioned that the FIGS. 5 and 6 also illustrate a film tube whose joined seams 27 join entire layers of film or material (A-D) to one another.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference symbols | |
|---|---|
| 1 | Device pursuant to the invention |
| 2 | Unwinding station |
| 3 | Deflecting roller |
| 4 | Deflecting roller |

-continued

| List of reference symbols | |
|---|---|
| 5 | Cutting station |
| 6 | Turning bar |
| 7 | Turning bar |
| 8 | Joining station |
| 9 | Roller |
| 10 | Roller |
| 11 | Turning bar |
| 12 | Roller |
| 13 | Roller |
| 14 | Squeegee roller |
| 15 | Squeegee roller |
| 16 | Roller |
| 17 | Roller |
| 18 | Roller |
| 19 | Roller |
| 20 | Arrow |
| 21 | Turning bar |
| 22 | Roller |
| 23 | Roller |
| 24 | Arrow |
| 25 | Side-gussetted film tube |
| 26 | Side gusset |
| 27 | Joint seam |
| 28 | Blind seams |
| 29 | |
| 30 | Roller |
| 31 | Extrusion device |
| 32 | Extruder |
| 33 | Extruder arms |
| 34 | Nozzle, nozzle area |
| 35 | Roller |
| 36 | Winding station |
| 37 | Machine frame |
| 38 | Roller |
| 40 | Film tube |
| 41 | Film tube pursuant to the invention |
| 42 | Film tube |
| 45 | Longitudinal register of the film web A |
| 50 | Roller clearance |
| 51 | Triangle made of section tubes |
| 60 | Motor |
| 61 | Fan |
| A-E | Film webs |
| U | Path of the flat film tube |
| V | Path of the flat film tube |

What is claimed is:

1. A process for manufacturing a bag from a polymer and/or metal film bag-forming material, comprising feeding the bag-forming material that is in a form of a single film web and that is wound up on a roll to an unwinding station of a bottom forming device, unwinding the wound film web with the unwinding station, cutting the unwound film web into four film segments, connecting the four film segments to form a film tube having four outer walls that are connected respectively by four seams, at least one part of the four seams of the film tube being formed by a joining process in which additional adhesive or extrudate joining material is applied on the seam, winding up the formed film tube, unwinding the wound film tube, and sealing the connected film segments so as to form at least one sealed end of the bag.

2. The process according to claim 1, wherein the film tube includes side gussets.

3. The process according to claim 1, wherein a bottom of the bag is formed by transverse sealing.

4. The process according to claim 1, wherein a bottom of the bag is formed by a squeezing process and a transverse sealing process.

5. The process according to claim 1, further comprising a step of filling the formed bag.

6. The process according to claim 5, wherein the step of forming the bag and the step of filling the bag are performed in a form, fill, and seal machine.

7. The process according to claim 1, further comprising a step of sealing a top end of the bag by transverse sealing.

8. The process according to claim 1, wherein a conveying direction of the four film segments to a joining station defines a longitudinal axis of the formed film tube.

* * * * *